United States Patent [19]

Christine

[11] 4,440,316

[45] Apr. 3, 1984

[54] COMBINED PIERCER AND VALVE FOR FLEXIBLE BAG

[75] Inventor: William C. Christine, Catasauqua, Pa.

[73] Assignee: Trinity Associates, Nazareth, Pa.

[21] Appl. No.: 387,436

[22] Filed: Jun. 11, 1982

Related U.S. Application Data

[63] Continuation-in-part of Ser. No. 124,971, Feb. 27, 1980, abandoned, and Ser. No. 317,261, Nov. 2, 1981, abandoned.

[51] Int. Cl.[3] ..... B67B 7/26

[52] U.S. Cl. ..... 222/83.5; 222/89; 222/183; 222/518

[58] Field of Search ..... 222/80, 81, 83, 89, 222/501, 511, 518, 559, 183; 137/DIG. 4; 251/335 B

[56] References Cited

U.S. PATENT DOCUMENTS

| | | | |
|---|---|---|---|
| 1,030,306 | 6/1912 | Hull | 222/518 UX |
| 1,759,459 | 5/1930 | Murdock | 222/89 X |
| 2,514,030 | 7/1950 | Coyle et al. | 222/511 X |
| 3,930,286 | 1/1976 | McGowen | 222/83 |
| 4,214,675 | 7/1980 | Schmit | 222/83 |

*Primary Examiner*—Joseph J. Rolla
*Assistant Examiner*—Frederick R. Handren
*Attorney, Agent, or Firm*—Sherman Levy

[57] ABSTRACT

A valve or tap is provided for use with a flexible film pouch or bag of the type that contains liquids or fluidic material, and wherein the valve includes a sealing flange or a fitment that is suitably secured or affixed to the outer surface of the film or bag, and a piercer is provided for selectively puncturing the bag or film when manual pressure is applied to a cap so that the material in the bag can be selectively dispensed from the bag.

20 Claims, 8 Drawing Figures

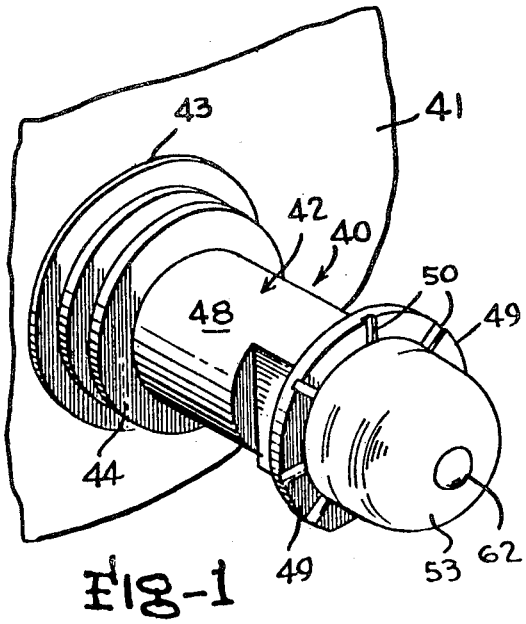
Fig-1
Fig-2
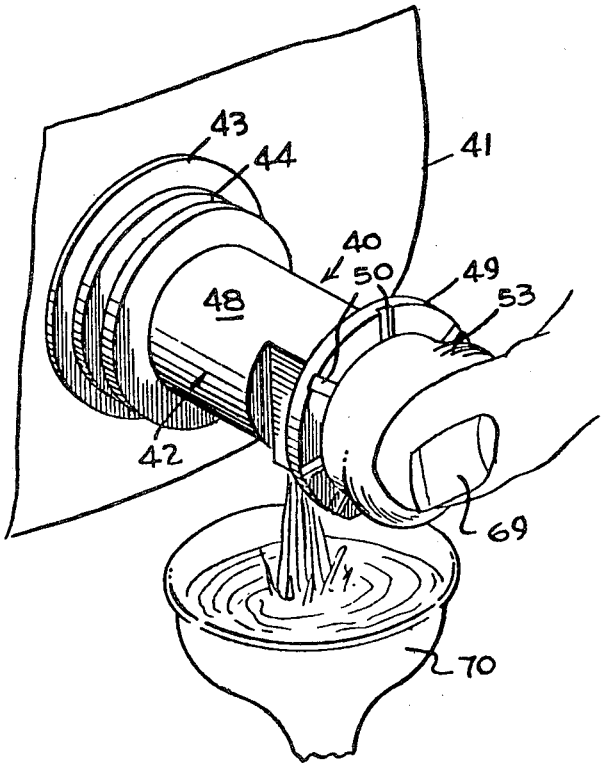
Fig-3
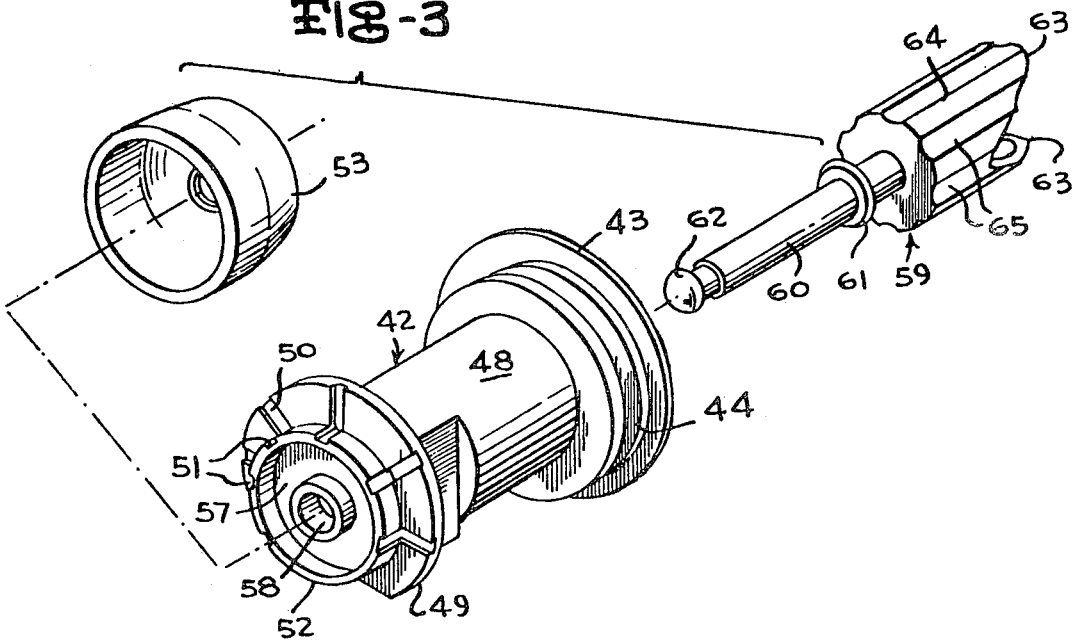

COMBINED PIERCER AND VALVE FOR FLEXIBLE BAG

CROSS REFERENCE AS TO RELATED APPLICATIONS

The present application is a continuation in part of U.S. Pat. application Ser. No. 124,971 filed Feb. 27, 1980, and U.S. Pat. Ser. No. 317,261 filed Nov. 2, 1981, both now abandoned.

FIELD OF THE INVENTION

The invention is concerned with a valve or tap for use with a bag such as a bag-in-a-box containing liquid or fluidic material to be dispensed.

DESCRIPTION OF THE PRIOR ART

Heretofore, various types of valves have been provided for selectively removing the contents of bags or containers, as for example attention is directed to prior U.S. Pat. Nos.: 787,591; 1,030,306; 1,759,459; 2,514,030; 3,343,724; 3,400,866; 3,474,933; 3,792,799; 3,930,286; 4,055,032; 4,214,675; and Swiss patent No. 152,462, dated May, 1932. However, neither these prior patents nor any others known to applicant achieve the advantages of the present invention.

Recently wine packages are being used wherein wine is sealed in a flexible film liner which is mechanically supported within a paperboard carton. The valve of the present invention, fitted to the liner in use protrudes through the carton so that the wine can be dispensed without violating the integrity of the liner, and since the liner is collapsible, entry of air is prevented. The advantage of this construction is that the wine remaining in the package is not exposed to oxygen which is detrimental to the quality of the wine. Comparing this with the pouring of the wine from a glass bottle, it is obvious that substantial oxygen is entrained into the wine during the decanting process, thus practically eliminating the shelf life of the wine after decanting has been commenced. Comparing this invention with other bag-in-box packages, the critical difference involves the oxygen permeability and the period of time from the packaging of the wine through its warehousing, transportation and distribution cycle to the user. Other bag-in-box packages require the perforating of the liner prior to the time that the wine is packaged so that the valve can be installed. With the present invention, oxygen cannot enter through the valve until the pouch is punctured at the point of use since the valve is entirely on the outside of the pouch. Thus, there will be no loss in quality during storage, distribution and retail marketing of the wine in such units due to entry of oxygen.

BACKGROUND AND SUMMARY OF THE INVENTION

The present invention is a valve or tap for use with a bag made of a material such as flexible plastic material that is adapted to hold a quantity of material therein such as wine. However, it is to be understood that the present invention is not limited to use with containers of wine since it can be used for containers holding any other material such as orange juice or any other liquid or fluidic material that lends itself for this purpose. A fitment or the sealing flange of the valve body is affixed to the outside of the flexible bag, there being a piercer which is selectively caused to puncture the bag when a cap is manually actuated or moved. The advantage of this construction is that the contents of the bag do not deteriorate because the bag is relatively impervious to oxygen until it is pierced by the user.

It is known that when wine for example is placed in plastic containers, that approximately one-third to one-half of the oxygen uptake of the wine occurs through the valve as a consequence of one punching the membrane of the pouch for filling the pouch or to admit the valve mechanism. The valve mechanism of the present invention precludes the permeation of oxygen through the valve since the pouch is filled as it is being formed, and the valve is located exterior to the pouch.

It is an object of the present invention to provide a valve for a bag wherein when it is desired to dispense a predetermined quantity of the material from the bag, the valve can be operated by pressing manually on a resilient cap with the thumb while holding the fitment between flanges that are conveniently provided thereon. This will push the piercer through the film, and as the piercer is activated, its valve seat moves, allowing fluid to pass through the port and discharge spout. An important advantage of the present invention is that the film is not pierced until the valve is put in use, and this is especially important in wine packaging where oxidation is a problem.

A still further object of the present invention is to provide a valve which can be easily operated and can be installed on the exterior of the pouch which assures oxygen impermeability, the valve being ruggedly constructed and relatively simple to manufacture and install automatically on a form/fill/seal machine as well as other machines and in addition be efficient in use.

Still another object of the invention is to provide a valve of such compact design that it can be installed on the pouch of fluidic products, and therefore conveniently and easily be folded into a position inside the box that contains the pouch being in a position convenient to an aperture provided for its use.

Other objects of the invention are to provide a valve for use with a liquid container wherein the valve is relatively inexpensive and disposable and not reusable and wherein there is provided a novel and improved relatively inexpensive construction and arrangement of a piercing valve and liquid outlet. The above and other features and objects of the invention will be apparent to those skilled in the art to which this invention pertains from the following detailed description and drawings.

BRIEF DESCRIPTION OF THE DRAWINGS

FIG. 1 is a perspective view showing one form of the valve attached to a portion of a plastic bag that is adapted to hold the material to be dispensed.

FIG. 2 is a perspective view showing the device being used for drawing liquid.

FIG. 3 is an exploded perspective view of the valve with parts separated for clarity of illustration.

DESCRIPTION OF THE PREFERRED EMBODIMENT

Figure 4:
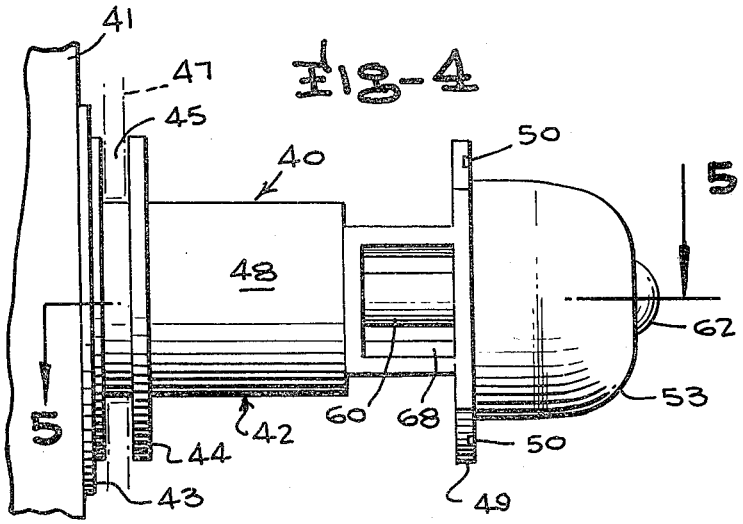
FIG. 4 is a bottom view of the valve.
Figure 5:
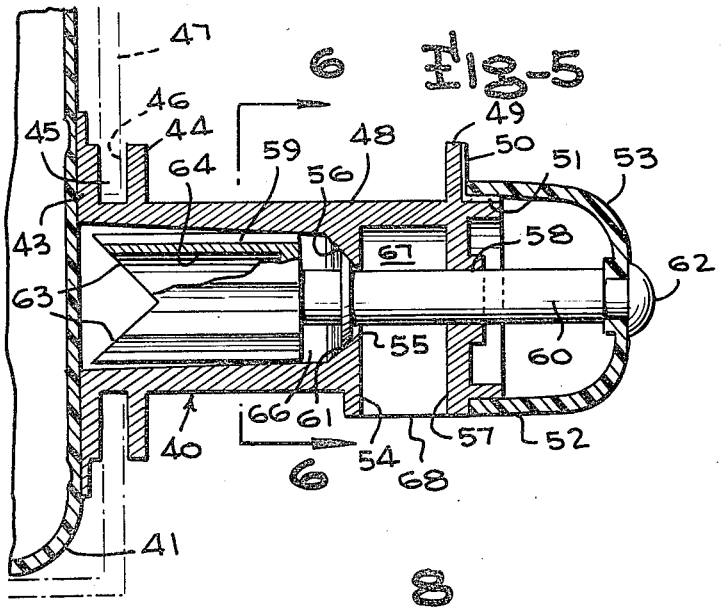
FIG. 5 is a sectional view taken on the line 5—5 of FIG. 4.
Figure 6:
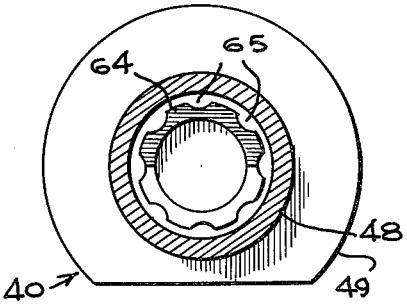
FIG. 6 is a sectional view taken on the line 6—6 of FIG. 5.

Referring in detail to the drawings, the number 40 indicates the valve of the present invention which is adapted to be used with a flexible film bag or pouch 41 that contains fluidic material or the like to be dispensed. As shown in FIG. 5 for example, the valve 40 includes a valve body 42 that includes a first inner flange 43 that is secured in any suitable manner to the outer surface of the pouch 41. The valve body 42 further includes a second flange 44 that is spaced outwardly from the flange 43 so as to define a space 45 between the flanges 44 and 43 for receiving an end portion 46 of a corrugated box or the like 47. The valve body 42 further includes a cylindrical portion 48 that has a third or outer flange 49 adjacent at its outer end, and the flange 49 is provided with a plurality of radially disposed slits 50 therein for a purpose to be later described. The valve body 42 further includes an outwardly projecting portion 52 that has a plurality of spaced apart slots or grooves 51 therein that communicate with the slits 50.

Figure 7:
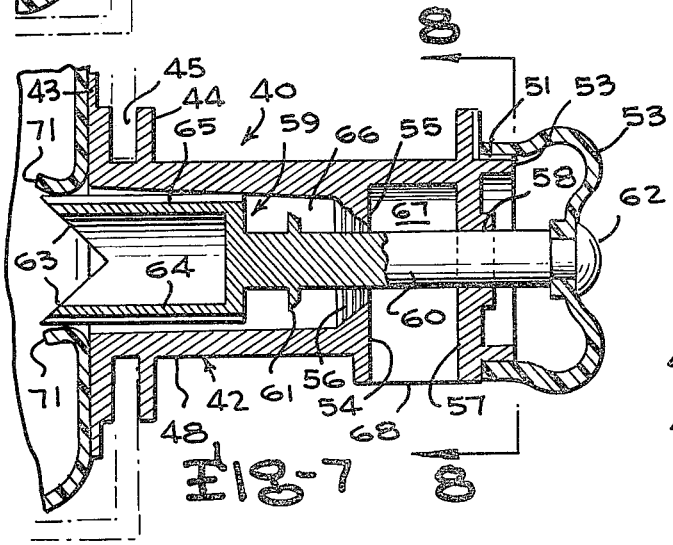
FIG. 7 is a view similar to FIG. 5 but showing the device in puncturing position.
Figure 8:
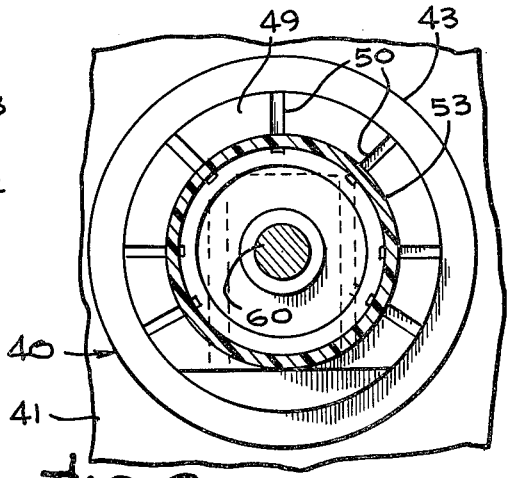
FIG. 8 is a sectional view taken on the line 8—8 of FIG. 7.

Arranged on the interior of the valve body 42 is a valve seat 54 that is formed on the inner portion of the cylindrical portion 48 of the valve body 42, and the valve seat 54 includes a central opening 55. As shown in FIG. 7 for example, the valve seat 54 has a plurality of rings or concentric ridges 56 thereon. The valve seat 54 is arranged on the interior of the cylindrical portion 48 of the valve body 42. There is provided on the outer end portion of the valve body 42 a wall portion 57 which has a central opening 58 therein.

The number 59 indicates a piercer shaft unit that includes a shaft portion 60 that has a valve element 61 thereon that is mounted for movement into and out of opened and closed relation with respect to the valve seat 54. A snap through fitting or bushing 62 on the outer end of the shaft portion 60 is engaged by the resilient cap 53.

The inner end of the piercer 59 includes a double point cutting edge 63 on a cylindrical section 64, and the cylindrical section 64 has a plurality of longitudinally disposed grooves 65 in its outer surface, FIG. 7. The number 66 indicates a space or hollow interior in the valve body so that when the parts are in the position of FIG. 7, the film 41 is punctured whereby the fluidic material can flow from the bag or pouch 41 through the grooves 65, into the space 66, through the opened valve seat opening 55, into the space 67, and then out through the discharge spout 68 in the bottom of the device. FIG. 2 shows the user's thumb being used to apply manual pressure to the deformable cap 53 to cause the cutting edges 63 to puncture the film whereby the material can be discharged into a waiting receptacle 70 or other desired location.

From the foregoing, it will be seen that there has been provided a valve assembly for use in dispensing controlled quantities of material from a pouch such as the flexible pouch 41. The material being dispensed may be wine or the like and it is to be understood that the present invention is not limited to any particular type of material to be dispensed. In use, with the parts arranged as shown in the drawings, the valve body 42 is arranged so that its flange 43 is suitably secured in any suitable manner to the outer surface of the film or pouch 41. Initially the parts are in a position such as that shown in FIG. 1 or as shown in FIG. 5. When it is desired to dispense a quantity of material from the pouch 41, it is only necessary to apply finger or thumb pressure by means of the thumb 69 to the flexible cap 53 so that the parts will move from a position such as that shown in FIGS. 1 and 5 to a position such as that shown in FIGS. 2 and 7. Thus, as manual pressure is applied to the cap 53, the piercer shaft element 59 will be moved or pushed inwardly whereby the double cutting edges or points 63 will puncture or pierce the film 41. Thus, material within the pouch 41 can flow through the punctured opening 71 that is formed in the pouch, and this material can then flow through the grooves 65 into the space 66. It will be noted that with the parts in the inward position of FIGS. 2 and 7, the valve element 61 is moved away from the valve seat 53 so that the material can flow from the space 66 through the valve seat opening 55 and into the chamber 67. The material can then flow by gravity down through the discharge opening or spout 68 into a waiting receptacle 70 or other area.

When manual pressure is released on the cap 53, due to the inherent resiliency of the cap 53, the parts will be automatically returned from the position shown in FIGS. 2 and 7 to a position such as that shown in FIGS. 1 and 5 so that the further flow of material will be blocked or prevented. Thus, with the parts in the position shown in FIG. 5, the valve element 61 is in closing relation with respect to the valve seat 54 so that no further material will be discharged or dispensed from the pouch.

The parts can be made of any suitable material and in different shapes or sizes as desired or required.

As shown in the drawings, the piercer 59 has the shaft 60 formed integral therewith. However, in certain instances the shaft may be made as a separate piece from the piercer, and then these parts can be suitably secured together. Likewise, instead of making the piercer with a double cutting edge, it may be made with a single sharp cutting edge or the like.

As shown in the drawings, the shaft 60 goes outside the cap 53 to prevent the cap from being pulled off. The slits 50 are provided for air flow to and from the cap 53 so that suitable provision is made for vacuum pressure prevention and the like. The valve seat 54 has the plurality of concentric rings or ridges 56 to help assure a tight seal between the valve element 61 and the valve seat. The cap 53 has a suitable construction to accommodate the snap through section of the shaft 62. The flange 43 may be heat sealed or otherwise secured to the outer surface of the pouch 41. In some instances, the device may be made with a fitment that is a separate piece from the valve body. The slots 51 register with the slits 50 so that sufficient air can enter the interior of the device in order to prevent vacuum formation from occurring. The present invention is especially suitable for use as a wine tap, but it is to be understood that the device can be used for controlling the dispensing of any material and is not limited to the use of wine.

The space 45 between the flanges 43 and 44 can snugly receive therein a portion of a cardboard box or the like in which the pouch 41 is arranged. A suitable protective closure can be arranged over the valve assembly to prevent accidental actuation of the device during shipment, storage and the like. The piercer 59 has on its inner end one or more sharp points or barbs 63 for selectively puncturing the bag or pouch 41. The cap 53 has a dome shape and is made of a suitable resilient material. The barbs 63 are adapted to selectively pierce or puncture the film 71 when the cap 53 is manually depressed by the thumb 69. When the parts are in the position shown in FIG. 2 or FIG. 7, the liquid or fluid can be dispensed in the desired and proper manner.

It will therefore be seen that there has been provided a valve or tap which is especially suitable for use in dispensing fluidic material or liquid from a flexible bag such as a bag of the type that is arranged in a cardboard box or the like. The valve is especially suitable for use in conjunction with such bags when wine is arranged in such bags, but as previously noted the present arrangement is not limited to any particular material and can be used wherever such materials are to be dispensed. With regard to wine bags, studies have shown that approximately one-third to one-half of the oxygen uptake of the wine occurs through the valve as a consequence of pre-punching the membrane of the pouch to admit the valve mechanism, and the packaging system and valve of the present invention precludes the permeation of oxygen through the valve.

When manual pressure is applied to the cap 53, the cap 53 is depressed or compressed, and the piercer shaft is moved so that the sharp edges 63 will puncture the film to provide an opening 71 so that wine or other liquid can then flow out by gravity through the puncture opening 71. When manual pressure is released on the cap 53, due to the inherent resiliency of the cap 53, the parts will automatically return from a position such as that shown in FIG. 7 to a position such as that shown in FIG. 5 whereby the valve element 61 will seal against the valve seat 54 to prevent any further flow of material through the valve until the valve is again actuated.

Presently, the wine industry is using bags with fittings thereon, and the prior such devices have certain important disadvantages that the present invention overcomes. In particular, with the present invention, oxidation of the contents of the bag is prevented or minimized, and this is due to the fact that the fitment is fixed to the outer surface of the film, and in addition the bag is not punctured until the wine or other liquid is to be dispensed.

An important advantage of this valve over prior devices is that the film is not pierced until the valve is put in use, and this is especially important in wine packaging where oxidation is a problem. Also, with the present invention, ease of operation is assured as well as oxygen permeability is properly handled. With the present invention, automatic assembly is readily accomplished, and the device can be efficiently oriented as when the entire tap assembly is made in an automatic feeder.

With the present invention, the integrity of the pouch is not lost and the valve will not leak and destroy the package so that air cannot enter and degrade the product. Thus, improved shelf life is provided as compared to pouches that are used with valves that require the pouch to be broken. Thus, a cleaner, tighter pouch with longer shelf life is provided since the flange 43 is affixed to the outer surface of the film 41.

In the Malpas U.S. Pat. No. 3,474,933, there is a loose valve which is put in the bottom of the carton. It is necessary for the user to open that portion of the carton, remove the valve, then install it in the fitments secured to the pouch and box. This is a very labor-intensive and expensive package to manufacture. The consumer is asked to install the valve, which is an unsuitable marketing feature.

It will be seen that there has been provided a valve or tap which is especially suitable for dispensing liquids such as wine from a pouch. The pouch 41 is adapted to be arranged in a collapsible cardboard carton, and such carton may include decorative material on its outer surface. The pouch 41 may be made of any suitable material such as transparent flexible plastic, foil or the like.

With the present invention there is provided a valve for use on a plastic pouch having two pieces and a seat with a common actuator so that a single actuation will operate the valve, and the initial actuation (first use) will in addition pierce the pouch. Further, there is provided a flange of heat-sealable material designed to be heat-sealed on the outside of the pouch automatically.

Further advantages of the present invention include one-handed operation and the concept of using a piercer which folds the film back to a hinge, neither of which is anticipated by prior patents such as McGowan.

While several embodiments of the present invention have been illustrated herein in particular detail, it will be understood that variations and modifications may be effected without departing from the spirit and scope of the novel concepts of this invention.

What is claimed:

1. A valve for use with a flexible film bag comprising a valve body including a first flange secured to the outer surface of said bag, a second flange spaced outwardly from said first flange, said valve body including a cylindrical portion, a third flange adjacent to the outer end of said cylindrical portion, there being a plurality of radially disposed slits in said third flange, an outwardly projecting portion on the outer end of the cylindrical portion, and said outwardly projecting portion having slots registering with said slits, a resilient deformable cap engaging the outwardly projecting portion of said valve body, a circular valve seat on the inner portion of said body, there being a plurality of concentric ridges on said valve seat, a wall portion on the outer end of said valve body, there being a central opening in said wall portion, a movable piercer including a shaft portion projecting through the opening in said wall portion, a snap through connector on the outer end of said shaft portion engaging said cap, a valve element on said shaft portion mounted for movement into and out of opened and closed relation with respect to said valve seat, said piercer including on its inner end a cutting edge, said piercer including a cylindrical section having longitudinally extending grooves in its outer surface, there being a discharge spout in the lower end of said valve body.

2. The structure as defined in claim 1 wherein the movement of the cap causes the piercer to selectively puncture the pouch.

* * * * *